United States Patent [19]

Izbicki

[11] 4,207,361

[45] Jun. 10, 1980

[54] CORROSION INHIBITED MANGANESE ALLOYS IN THERMAL METALS

[75] Inventor: Anthony J. Izbicki, Reading, Pa.

[73] Assignee: Hood & Company, Inc., Hamburg, Pa.

[21] Appl. No.: 925,436

[22] Filed: Jul. 17, 1978

[51] Int. Cl.[2] ..... C23C 3/00

[52] U.S. Cl. ..... 427/328; 427/436; 428/655; 428/618; 428/674

[58] Field of Search ..... 427/328, 436; 204/38 B; 428/655, 674, 680, 616, 617, 618, 619

[56] References Cited

U.S. PATENT DOCUMENTS

| | | | |
|---|---|---|---|
| 2,873,214 | 2/1959 | Schnable | 427/433 X |
| 3,029,158 | 4/1962 | Lee et al. | 427/438 X |
| 3,186,863 | 6/1965 | Foley | 427/304 X |
| 3,359,084 | 12/1967 | Cape | 428/656 X |
| 4,050,906 | 9/1977 | Ornstein | 428/617 |

OTHER PUBLICATIONS

Missel, Tech. Proc. Am. Electroplaters' Soc. 1956, pp. 17–21.

*Primary Examiner*—Ralph S. Kendall

[57] ABSTRACT

The surface of manganese alloys is protected from corrosion by directly exchanging the manganese on the surface of the alloy with a more noble metal, such as nickel, by intrinsic voltaic couple deposition. The invention finds particular utility in protecting manganese alloys from corrosion when used as a thermostat metal.

1 Claim, No Drawings

CORROSION INHIBITED MANGANESE ALLOYS IN THERMAL METALS

BACKGROUND OF THE INVENTION

1. Field of the Invention

This invention relates to corrosion resistant manganese alloys and more particularly to the manufacture of bimetals that utilize manganese alloys as the high thermal expansive metal.

2. Description of the Prior Art

Composite thermostat metals (bimetals) are made of metalurgically bonded layers of various metals, at least one of which having a relatively high coefficient of thermal expansion and at least one other metal having a relatively low coefficient of thermal expansion. When the thermostat metals are subjected to temperature changes, the differences in the thermal expansion of the several layer materials give rise to stresses that are relieved by a flexing of the bimetal. This flexing or bending is utilized in variously conventional ways to actuate controls or the like in response to a temperature change. The amount of flexing which occurs in the thermostat metal in response to a temperature change is referred to as the "flexivity" of the thermostat metal and the flexivity of a given thermostat metal depends upon the difference of the thermal expansion properties of the several metals of the composite thermostat metal. To achieve high flexivity, special metal alloys are employed which either have a relatively high or a relatively low coefficient of thermal expansion.

The present invention has as its object the utilization of manganese alloys as the component of the bimetal that has the high coefficient of thermal expansion. Two alloys of this sort that are commonly available on the market place are comprised of 72% manganese, 18% copper and 10% nickel (72/18/10) and 75% manganese, 10% copper and 15% nickel (75/10/15). In addition to the high coefficient of thermal expansion ($14.7\times10^{-6}$ and $15.7\times10^{-6}$ respectively) these alloys also are desirable as the component of a thermostat bimetal since they have high electrical resistivity, both in excess of 1000 ohms/cir mil ft. High electrical resistivity is important when a thermal response of the bimetal to an electrical current is desired as, for example, in circuit breakers and other current limiting devices.

While the coefficient of thermal expansion and electrical resistivity make manganese alloys in many ways ideally suited for use as a thermostat metal, those alloys have not been widely used due to the high chemical reactivity of manganese. For example, as given in the literature, manganese is listed 37th in the group of 43 metals for its thermodynamic nobility (immunity) and 43rd out of 43 for its practical nobility (immunity and passifation).

Not only do manganese alloys rapidly corrode under ambient conditions in which any moisture is present but the surface oxide layers that form are not protective and, given sufficient time, the metal alloy will eventually degrade to a powdery mass.

The corrosion of the manganese alloy is not only destructive, but the oxide layer makes it difficult to unit the alloy surfaces to other components of thermostats as by using conventional soldering or spot welding techniques. To obtain good adhesion between the elements, the manganese surface must be cleaned from oxide deposits. For these reasons, one must accept the problems of special storage, handling and cleaning techniques if the desirable advantages of manganese alloys are to be enjoyed as thermostat metals.

In U.S. Pat. No. 3,838,986 a method is proposed in which the surface oxide layer of manganese alloys can be tolerated in welding the alloy as part of a bimetal to another element of a thermostat. This patent discloses placing a layer of tin over the manganese oxide surface of the thermostat metal which, during resistance welding to a metal component of the thermostat, will absorb expelled manganese oxide and avoid the formation of weld flash. This method is not entirely satisfactory as it adds to the cost and, for the protective metal to be effective, it must be of sufficiently heavy gauge to retain its integrity during bonding. Since protective metals such as tin do not have the high expansive and high resistive properties of the manganese alloy, protective metals such as tin, to the extent that they are used, detract from the properties of the bimetal.

It has also been proposed that the manganese alloy be protected by electroplating a protective metal over its surface. This has proved unsatisfactory since, due to the extreme chemical reactivity of the manganese, it is not practical in the present state of the art to adequately control the electroplating operation.

Attempts also have been made to deposit protective metals on the surface of the manganese alloy by autocatylitc methods in which the surface deposition of a protective metal is obtained by immersing the alloy in a solution of a metal salt and a reducing agent. This process also has proven difficult to control again due to the extreme chemical reactivity of the manganese alloy.

Accordingly, it is an object of this invention to protect manganese alloys from corrosion.

Another object of this invention is to protect the surfaces of manganese alloys from corrosion so that they will be practical for use as thermostat metals.

These and other objects of this invention are achieved by directly replacing the manganese in the outermost surface layer of the alloy with a more noble metal, such as nickel, by intrinsic voltaic couple deposition. In this process, a direct electrochemical reaction takes place between the manganese metal and a metal ion to cause a replacement of the surface layer of manganese with the metal of the solution. For example the reaction of manganese with a nickel solution is $$Mn + Ni^{++}(\text{solution}) \rightarrow Ni + Mn^{++}(\text{solution})$$

The electric potentials are:

| | |
|---|---|
| $Mn = Mn^{++} + 2e^-$ | +1.18 |
| $Ni = Ni^{++} + 2e^-$ | +0.25 |

$E^\circ$ for the $Mn:Ni^{++}$ couple is +0.93 indicating that the reaction is strongly favored. Control over the process is not particularly critical since the reaction will proceed only until the surface layer of manganese has been depleted and then the reaction will stop. This results in a protective coating that perhaps is only about 0.1 microns thick but this is sufficient to protect the alloy from chemical degradation and provide a shiny, oxide free surface to which other metals readily can be attached as by resistance welding or soldering.

EXAMPLE I

A bimetal was prepared using a 72-18-10 manganese alloy as the high expansive element and Invar (36%

Ni,balance Fe) as the low expansive metal. The bimetal was made from 80% by volume of the manganese alloy and 20% by volume of Invar which ratio is not critical. Similar results can be obtained using other ratios and other low expansive thermostat metals. The bimetal was submerged in a bath made up of:

| | |
|---|---|
| $Ni\ SO_4(NH_4)_2\ So_4 \cdot 6H_2O$ | 44gm. |
| $Ni\ SO_4$ | 44gm. |
| Water (5 grains) gal. hardness | 800 cc. |

It was found that manganese on the surface of the alloy was replaced by nickel in an amount sufficient to provide corrosion resistance in 30 seconds at 25° C. and in only 10 seconds at 70° C. Samples treated in this manner were immersed in boiling water for 30 minutes and they remained bright and uncorroded. Untreated samples became black and pitted when similarly exposed to the boiling water. Further, the samples treated in the practice of this invention did not suffer any material loss in desired properties. The control has a flexivity of $151\times10^{-7}$ and a resistivity of 873 ohm/CMF compared to a flexivity of $147\times10^{-7}$ and a resistivity of 870 ohm/CMF for the treated sample.

While nickel was used as the more nobel metal in this example to replace the manganese on the surface of the alloy other more nobel metals, such as copper, can be used and their selection is well within the skill of the art.

EXAMPLE II

To prove the effectiveness of this invention when using a metal other than nickel as the more nobel metal, the following solution containing copper ions was prepared:

| | |
|---|---|
| $Cu\ SO_4$ (anhydrous) | 11.3 gms. |
| $NH_4\ CL$ | 5.7 gms. |
| Glacial Acetic Acid | 2.83 gms. |
| Water | 200 gms. |

A bimetal as described in Example I was immersed in the above solution and it was found that the manganese was replaced on the surface of the alloy with an extremely thin protective layer of copper. The time required was on the order of 10 seconds at room temperature.

The copper layer deposited on the surface of the manganese alloy not only provides protection from corrosion, but also is a good surface for receiving solder. When a 60/40 rosin core solder was used, it uniformly wet out the copper surface and provided an excellent bond.

It may be noted that when nickel is used to replace the manganese surface, the nickel is a good surface for spot welding, but is not wet out by solder. Therefore copper is used for soldering whereas nickel may be preferred for spot welding.

I claim:

1. In the manufacture of bimetals, a method for inhibiting the corrosion a high thermal expansive metal selected from the group consisting of 72% manganese, 18% copper, and 10% nickel; and 75% manganese, 10% copper, and 15% nickel; the improvement comprising cleaning the surface of the metal; contacting the cleaned surface of the metal with an aqueous solution containing the ionized salt of a metal more noble than manganese selected from the group consisting of nickel and copper; and exchanging the surface layer of manganese with the more noble metal by intrinsic voltaic deposition.

* * * * *